United States Patent [19]

Palma

[11] 4,019,686

[45] Apr. 26, 1977

[54] WATER SPRINKLER OPERATED BY REGULARLY VARYING WATER PRESSURE

[76] Inventor: Florencio Neto Palma, 263 Keele St., Toronto, Ontario, Canada

[22] Filed: May 27, 1975

[21] Appl. No.: 580,922

[52] U.S. Cl. ..... 239/205; 239/206; 239/239; 239/262; 239/569; 239/DIG. 1

[51] Int. Cl.[2] ..... B05B 1/30; B05B 3/06; B05B 15/10

[58] Field of Search ..... 239/97, 99, 201, 203–206, 239/225, 236, 237, 239, 240, 241, 261, 262, 264, 569, DIG. 1

[56] References Cited

UNITED STATES PATENTS

| | | | |
|---|---|---|---|
| 2,595,114 | 4/1952 | Wieseltier | 239/97 |
| 2,600,987 | 6/1952 | Gallice | 239/97 |
| 2,723,157 | 11/1955 | Thompson | 239/DIG. 1 X |
| 3,408,006 | 10/1968 | Stanwood | 239/97 X |

*Primary Examiner*—Evon C. Blunk
*Assistant Examiner*—Andres Kashnikow
*Attorney, Agent, or Firm*—K. Maxwell Hill

[57] ABSTRACT

A sprinkler for watering an area having a specific shape using water subject to an intermittent and regular variation in pressure introduced against a patterned plate positioned in the base of the sprinkler. The plate is situated adjacent to a slotted opening in the lower solid side of a hollow head moveable under water pressure within a cavity formed between the base and a cap of the sprinkler. A nozzle is attached to the upper end of the head to distribute the water passing the restricting window and segment of pattern disposed in its path in the base. Springs are associated with the head to provide a torque to the sprinkler head as the head rises in the cavity under pressure of the water on the lower side of the head. A gear and ratchet is provided on the head to prevent the head from returning to the first position upon reduction of the water pressure and resultant reaction of the springs to return the head to its position of rest within the cavity.

4 Claims, 7 Drawing Figures

WATER SPRINKLER OPERATED BY REGULARLY VARYING WATER PRESSURE

FIELD OF INVENTION

The present invention relates to a water sprinkler of the kind employing heads and nozzles actuated by water flowing at variable pressure controlled by modulating valves.

The invention herein resides in the provision of a stepping means operable by variable pressure which combines with a return spring, and an actuating memory plate valve to result in an even distribution of precipitation over an odd shaped area.

PRIOR ART

It is known that common sprinkler systems will provide precipitation in a generally circular shape around the sprinkler where the furthest point of fall of the water will be at an equal radius around the sprinkler. It is also known that by using variable pressure valves the amount of water falling in a circular area can be made even.

OBJECT OF THE PRESENT INVENTION

It is an object of the present invention to provide a sprinkler system which can lay down a uniform amount of precipitation upon an odd shaped surface area. The above object is provided by the unique combination of a plate member having the pattern of the area to be watered formed therein and a decoding plate, operated by a stepping mechanism.

A further object is to provide hardware of the character herewith described, which is designed to sell at the lowest possible price consistent with a high level of performance and efficiency and is of maximum constructural simplicity. With my sprinkler a very large area employing many sprinklers each having different decoding memory plates can employ a single pressure modulation valve to be switched on by a single controller. A further advantage of my sprinkler is that a large and extensive area can be watered uniformly, without waste or watering of undesired areas.

With the considerations and inventive objects herein set forth in view and such others as may become apparent from consideration of this disclosure and specification, the present invention consists of and is hereby claimed to reside in the concept embraced or included in the means method process and construction and arrangement or combination or parts, or new use of any of the foregoing herein exemplified in one or more specific embodiments of such concept, reference being had to the accompanying drawings in which like characters of reference designate similar parts in the several views.

IN THE DRAWINGS

Figure 1:
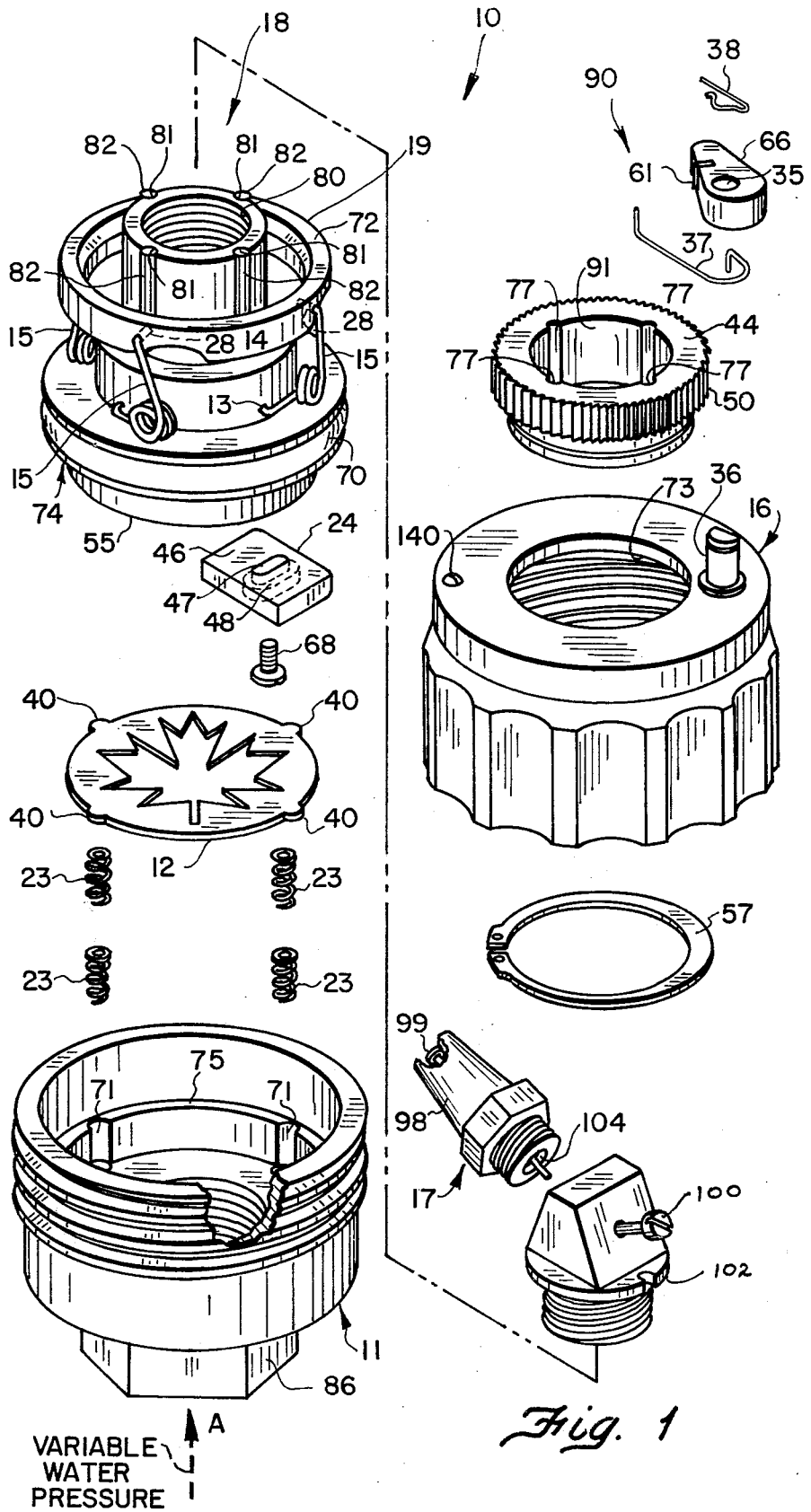
FIG. 1 is an exploded view of one embodiment of the present invention showing a sprinkler head, nozzle, and the disposition of the coding plate and memory plate in the path of the flow of the water and the means of attachment of a stepping mechanism within the head.

The sprinkler was generally designated 10, consisting of a memory plate 12, a decoding plate 24, a stepping mechanism 19, 44, which can be adjusted for variable angles, and nozzle 17 all mounted in base 11. Head 18 retains the stepping gear and clutch within base 11 and holds nozzle 17.

The sprinkler 10 comprises of a base member 11 and a head proper 18, the head proper is held in relation to the base by a cap member 16 which is a retaining ring. In its position of rest the head 18 is retracted by the action of torque springs 15. The memory plate 12 is held against the coding plate 24 by the action of springs 23. By means of a valve (not shown) the water pressure can be made to rise and flow into the head in a direction shown by arrow A. The pressure of the water gradually forces the head 18 up into cap 16 which is threadably mounted in base 11, and the pressure compresses the springs 15 forcing the stepping mechanism gear 44 to advance one step and the decoding plate 24 to read a portion of the memory plate 12 that is set opposite decoding plate after the decoding plate has stepped over the memory plate. Under the influence of the flow of water, the springs 15 react to store energy which is released as the pressure drops. The release of the springs 15 completes the cycle or one step of the programme.

The decoding plate 24 is fitted to the underside of sprinkler head 18 and thereby moves up and down with it under the action of the springs 15. The memory plate 12 is free to move up and down but cannot rotate. The decoding plate 24 is located above the memory plate 12. The decoding plate 24 comprises, block 46 adjustably fitted in a cavity 141 in the bottom 55 of head 18 to allow variable volume of water to pass into the head through a slotted opening in the cavity and through the head. The slot is the only opening through the solid bottom 55 of head 18. The slot size is controlled by the block 46 of plate 24 being adjustably mounted and clamped in the cavity by screw 68, adjustable in oversize hole 47. Cavity 48 allows the head of screw 68 to be countersunk into block 46.

The stepping mechanism 19, 44 has gear teeth 50 which permit adjustment of the nozzle 17 in steps of three degrees. By the provision of a check-valve, the stepping sprinkler of the present invention can be converted quite easily into a pop-up sprinkler.

The clutch ring 19, is mounted for free upward movement in base 11 and inside cap 16 to be freely rotatable therein. The toothed gear 44 is fixed in the upper portion of the cap 16 by retaining ring means 57 and is rotable within cap 16, Dog 61, held in linkage 66 prevents gear 44 from rotating in any but one 'advance' direction.

The decoding plate 24 is slid across the slot in bottom 55 of head 18 by means of screw 68 which can set the size of the opening of the slot by moving block 46 in the cavity in the head bottom and then by clamping of screw 68 in hole 47.

A pulsating water pressure provides the opportunity for reaction of springs 15, thereby resulting in a reciprocating action of head clutch 18 within a cavity formed between base 11 and cap 16 that provides the movement to 19 that provides torque and incremental stepping to gear 44. The incremental movement of head 18 imparts a corresponding incremental turn to decoding plate 24 which is attached to bottom 55 of head 18.

During each pulse of water pressure the decoding plate 24 will be disposed differently with relation to pattern plate 12. The slot is disposed radially of the bottom 55 of head 18 such that upon each movement of the decoding plate 24, slot will be over a different quarter segment of pattern in the memory plate 12. With each pulse of water the slot 148 will be restricted by a different amount dependent upon the area of pattern below it. Each different area of pattern permits variation in volume of water passing through the slot up into the nozzle and from the nozzle to shower a variable segment of area of the plot being watered, the area watered thereby bears a direct relation to the shape of the pattern put into the base 11. A maple leaf design of program is shown but any shape can be placed as pattern 12.

For durability and long wearing service the head 18 is sealed from the water in base 11 by O ring seal 70.

Cap 16 is threadably adjusted in base 11 to permit adjustment of cavity size and stroke of the piston action of head 18 therein.

Protrusions 40 are provided in the rim of the memory plate 12 in order that the plate can be positioned in grooves 71 in the base 11 to assist an operator to reference the plate within the sprinkler and thereby properly locate the sprinkler in the area to be watered.

MODE OF OPERATION

In FIG. 1, the clutch ring 19 is shown in the expanded position with springs 15 in the unstressed pose, when there is no pressure from water upwards at arrow A. In this position the upper surface 72 of clutch ring 19 will bear against the upper inside surface 73, of the cap 16, and the flange 74 on the lower side of head 18 will bear against the shoulder 75 formed within the base member 11 thereby providing a firm upward and downward enclosure for the piston head assembly 18 which is otherwise able to rotate within the cavity formed for it between the cap 16 and base 11 in the direction allowed by the ratchet device 90 provided by the combination of the dog 61 against teeth 50 of gear member 44. The gear 44 is formed with semicircular slots 77 and the upper portion 80 of head 18 is provided with semicircular slots 81, into which roller rods 82 smoothly interfit.

Gear 44 mates with head 80 and is keyed in rotating alignment therewith by the keying roller rods 82 to provide a wear resistant assembly of gear and piston head and to allow the head to ride upwards into the gear cavity 91.

The stepping mechanism of the assembly acts as follows: A pulse of water pressure from a pipe system attached to the bottom 86 of base 11, passes up through the base against the decoding plate and bottom 55 of head 18 forcing the clutch ring to bear against the cap 16, the springs 15 compress thereby imparting a torque to clutch ring 19 that allows the head to ride upwards on the guide roller rods 82 under pressure of the water below against base 55 of the piston head 18. The torque imparted to the rising assembly is transferred to the gear 44 connected by keys 82 to head 18 which turns a required amount or step; say 3 degrees. When, by means of a pulse or modulation valve (not shown) the water pressure at A is reduced to nothing the action against the piston assembly or head 18 is arrested and the energy stored in the springs 15 then causes a reaction against the head 18 returning it to the position of rest against shoulder 75. The action of dog 61, in one of teeth 50, of gear ring 44, prevents the clutch assembly 19 from stepping the head back to the original position as the reverse torque of springs 15 releasing would otherwise cause. The sprinkler then is ready for the next pulse of water pressure with the coding plate 24 stepped over the pattern the set amount of arc ready for "reading" the new segment of pattern upon application of the next pulse of water pressure when the combination of springs 15 causes torque to the head and steps the gear 44 another notch which is again held by dog 61 with release of the pressure at the valve. Thus the pattern of plate 12, or any other pattern plate in its place, can be read step by step to allow a variable volume of water to be introduced at each step according to the area of the decoding plate covered by the pattern outline at the time the water is forcing the head upwards thereby dissapating the water pressure. The variable volume of water passes into the hollow interior of the head 18 and on up into nozzle assembly 17, comprising a nozzle head 98, and a flow control valve 99. An adjustment bolt means 100 protrudes through a bottom part of 102 of the nozzle assembly 17 into the water passage 104 of the nozzle to allow an operator to control the flow and throw of the water limited by the sprinkler.

The ratchet assembly 90 has a hole 35 which fits over a pin or post 36 fixed and protruding from cap 16. A tension spring 37 retains linkage 66 of ratchet assembly 90 in engagement with gear 44 when linkage 66 is set over pin 36 and pivotable thereon. A retaining spring 38 keeps linkage 66 from jumping off pin 36.

Figure 2:
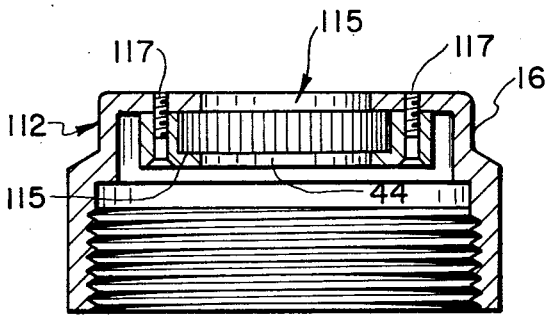
FIG. 2 is a cross section view of an alternate construction of the stepping gear.
Figure 4:
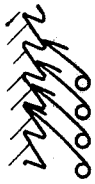
FIG. 4 shows the manner of operation of the dogs out of phase with one another.
Figure 3:
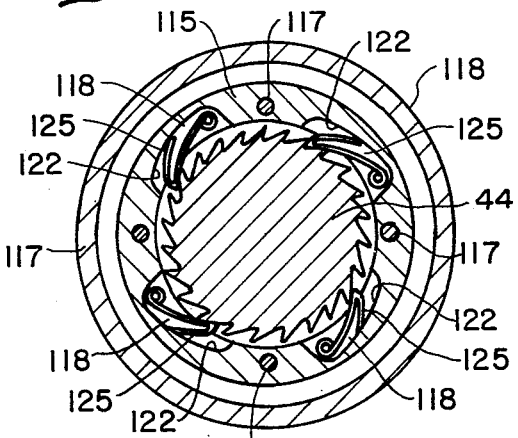
FIG. 3 is an alternate gear mechanism shown from the top having four dogs each acting over 12° range.

An alternate construction for a clutch gear 44 is shown in FIG. 2, where it is placed in the interior of a cap 16 that has had its upper part 112 elongated to create an enlarged interior for receiving the gear and an alternate ratchet assembly 115. The ratchet 115 means is held to the cap 16 by bolt means 117. FIG. 3 shows an alternate view in plan of the ratchet assembly of FIG. 2 where four dog carrying linkages 118 are used to replace the single dog and ratchet of FIG. 1. The gear 44 has ¼ as many teeth as the gear of FIG. 1 but can still provide an equal number of steps as each of dogs 118 will be out of phase with an adjacent dog 30 to operate every 12°. FIG. 4 shows the way each dog will be positioned when one dog is acting with the gear. If a tooth has an arc of 12° for example, the four dogs divide the arc into 4 segments or arcs of 3°. With this arrangement the number of teeth in the gear 44 can be reduced and its effective life extended.

Figure 5:
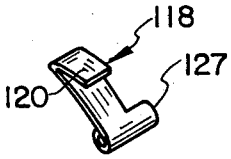
FIG. 5 is a perspective view of a clutch dog detailing its shape for fitting into the gear housing.

The shape of the dog 118 as used in the alternate assembly is shown in FIG. 5 where leaf spring members 120 is resistance welded to the dogs to keep them in engagement with the gear. The leaf springs 120 are held in the linkage or ratchet housing 115 by a wall 122 formed by a cavity 125 made for each dog. A shoulder 127 is made for the lower side of each dog to hold it in a slot formed in the bottom of the cavity 125 of the ratchet assembly housing 115.

Figure 6:
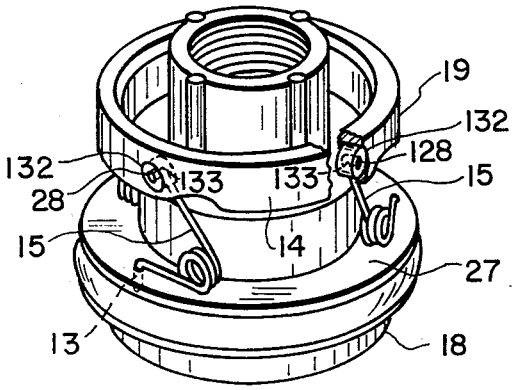
FIG. 6 is an alternate construction for a torque spring having a roller means attached to the end of the spring held in the torque ring for enhanced wear resistance.
Figure 7:
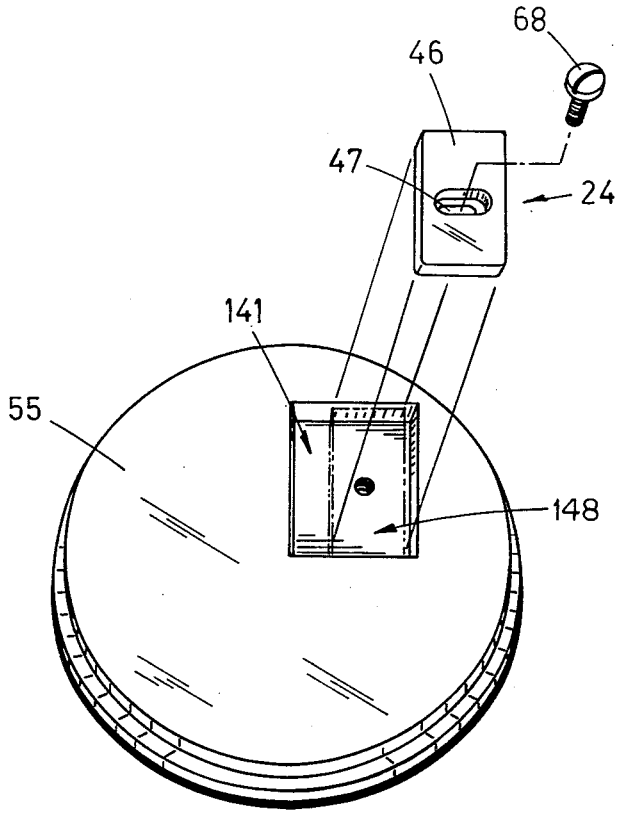
FIG. 7 is a bottom view of the head.

In FIG. 6, an alternative method of attaching springs 15 to the clutch ring bearing member 19 is shown. A doughnut shaped friction roller ring 132 is rotably mounted in the side wall 14 of clutch 19. Spring end 13 is mounted into the flange 27 of the head 18 and the other end 28 of spring 15 passes up into the friction roller to enter a central hole 133 in the roller where it is crimped to hold fast therein. As the spring compresses the outer surface of the friction roller bears the force of the torque in the clutch ring wall 14 thereby reducing the wear between the spring and the clutch ring.

Various modifications may be made to the invention described and be within the scope of the concept disclosed. It is intended, therefore, that the foregoing disclosure shall be considered as illustrative of such concept and not as limiting the protection sought by the inventor to any particular embodiment thereof.

It will be appreciated that from the foregoing the slot or window in the bottom of the head extends from the centre of the bottom to a point near its edge over a radius thereof to insure that all parts of the pattern are exposed to the water pressure a step at a time. Any particular segment of pattern of the memory plate will during a step be uncovered and will be translated into pressure variation at the nozzle which in turn will govern the distance of throw that reproduces the pattern in the watered area.

It is also noted that the angle of step can be determined by the stroke of the sprinkler head which is governed by the amount or distance the cap 16 is threaded onto the base 11. When the desired stroke is found for a particular water pressure and pattern, the cap is set on the base by set screw 140.

In order that the head can be aligned in the area watered a reference point can be made in the base of the sprinkler to correspond with a set point in the pattern. The sprinkler will then be positioned in the watered area to insure that the pattern plate is aligned with the area using the mark as the reference point.

What I claim is:

1. A water sprinkler having an inlet connected to a source of water varying with regular pulses of pressure from a preset maximum to a preset minimum, comprising in combination;

a head movably contained within a cap and a base, said inlet being connected to said base to introduce water therein, said head being hollow with a solid bottom having a window opening therethrough;

a plate having particularly shaped pattern cut therefrom positioned between said base and said bottom of said head, said opening serving to restrict the passage of water into said head thereby decoding said pattern into a variable volume of water passing into said head;

spring means adapted to provide a torque to said head within said cavity in reaction to a maximum pulse of the water pressure on the bottom of said head; means for preventing the head from returning to its untorqued position in said cavity upon reduction of said pressure to said minimum and action of said spring means returning said head to an extended position within said cavity, thereby to provide a stepping of said opening in said bottom over said pattern;

and a water nozzle outlet in said head for distributing a varying flow and throw of water in step with the variation of segmented portions of the pattern.

2. A water sprinkler as in claim 1, wherein said cap is threadably mounted to said base to provide a cylindrically walled cavity therebetween and wherein said head bottom is ring shaped to interfit for piston-like movement within said cavity.

3. A water sprinkler as in claim 1, having a gear with teeth thereon rotatable with said head and having a ratchet means fixed to said cap and engagable with said teeth to prevent said gear from returning to an untorqued position after the head has been subject to a maximum and a minimum pulse of water pressure, each of said teeth being a minimum step in the decoding of said pattern by said opening with each pulse of pressure from the water source.

4. A means for distributing water as claimed in claim 1, having an adjustably slidable block inset into the bottom of the head adjacent said opening to partially close the opening provided through said bottom thereby to control the water flow therethrough.

* * * * *